US009784527B2

(12) United States Patent
Helms

(10) Patent No.: US 9,784,527 B2
(45) Date of Patent: Oct. 10, 2017

(54) SECURING PLATFORM ACCESSORIES

(71) Applicant: BLACK MUTT DESIGNS LLC, Nampa, ID (US)

(72) Inventor: Jesse Louis Helms, Nampa, ID (US)

(73) Assignee: Black Mutt Designs LLC, Nampa, ID (US)

( * ) Notice: Subject to any disclaimer, the term of this patent is extended or adjusted under 35 U.S.C. 154(b) by 353 days.

(21) Appl. No.: 14/554,160

(22) Filed: Nov. 26, 2014

(65) Prior Publication Data

US 2016/0349004 A1 Dec. 1, 2016

Related U.S. Application Data

(60) Provisional application No. 61/926,630, filed on Jan. 13, 2014, provisional application No. 61/912,668, filed on Dec. 6, 2013, provisional application No. 61/911,266, filed on Dec. 3, 2013.

(51) Int. Cl.
*F41C 23/22* (2006.01)
*F41C 23/16* (2006.01)
*F41G 11/00* (2006.01)

(52) U.S. Cl.
CPC ..... *F41C 23/22* (2013.01); *F41C 23/16* (2013.01); *F41G 11/003* (2013.01)

(58) Field of Classification Search
CPC ..... F41C 23/00; F41C 23/16; F41C 23/22; F41C 27/00; F41C 27/22; F41G 11/003
USPC ..... 42/71.01, 72, 75.03, 90, 106; 89/1.42
See application file for complete search history.

(56) References Cited

U.S. PATENT DOCUMENTS 2,943,547 A 7/1960 Martin
3,062,114 A 11/1962 Palos
4,835,621 A 5/1989 Black
6,425,697 B1 * 7/2002 Potts ..... F41A 33/00 352/243
9,062,933 B1 * 6/2015 Allen ..... F41G 1/35
2004/0045207 A1 * 3/2004 McNulty, Jr. ..... F41B 15/04 42/40
2007/0157502 A1 7/2007 Holmberg
2007/0157503 A1 7/2007 Holmberg
2008/0205037 A1 * 8/2008 Griffin ..... F21V 21/08 362/110
2009/0140015 A1 * 6/2009 Faifer ..... F41C 23/16 224/191

(Continued)

FOREIGN PATENT DOCUMENTS

WO 2013096110 6/2013

OTHER PUBLICATIONS

KAC's iPod Mount. Soldier Systems: An Industry Daily. Jun. 18, 2009 [retrieved Oct. 3, 2013]. Retrieved from the Internet: <URL: http://soldiersystems.net/2009/06/18/kacs-ipod-mount/>. Nerf N-Strike Elite Battle App Tactical Rail Mount Accessory. Nerf. 2013 [retrieved Sep. 9, 2013]. Retrieved from the Internet: <URL: http://www.hasbro.com/nerf/en_US/shop/details.cfm?R=98F357AD-5056-9047-F583-A47D1C38E59B:en_US>. KAC iPod Mount. King Optic USA. 2013 [retrieved Oct. 3, 2013]. Retrieved from the Internet: <URL: http://www.kingopticusa.com/product_p/kac25695.htm>.

(Continued)

*Primary Examiner* — Bret Hayes
(74) *Attorney, Agent, or Firm* — Colby Nipper

(57) ABSTRACT

Securing platform accessories are described herein. An example securing platform accessory comprises a rail mount, an electronic device holder, and a handle. The rail mount includes one or more guides that are sized and configured to allow the securing platform accessory to be releasably attached to a securing platform, such as a tactical rail on a firearm.

21 Claims, 5 Drawing Sheets

(56) References Cited

U.S. PATENT DOCUMENTS

| | | | | |
|---|---|---|---|---|
| 2011/0047850 | A1* | 3/2011 | Rievley | F41C 23/16 42/72 |
| 2011/0047851 | A1* | 3/2011 | Mock | F41C 23/16 42/72 |
| 2011/0099878 | A1* | 5/2011 | Moody | F41A 23/08 42/90 |
| 2011/0185617 | A1* | 8/2011 | Brixius | F41C 23/16 42/71.01 |
| 2012/0080465 | A1 | 4/2012 | Son | |
| 2012/0167441 | A1* | 7/2012 | Holmberg | F41G 11/004 42/119 |
| 2012/0174456 | A1 | 7/2012 | DePierro et al. | |
| 2012/0240444 | A1 | 9/2012 | Russell | |

OTHER PUBLICATIONS

Tactical iPhone Rail System. Instructables. 2013 [retrieved Oct. 3, 2013]. Retrieved from the Internet: <URL: http://www.instructables.com/id/Tactical-iPhone-Rail-System/>.

Inteliscope. inteliSCOPE Premier Tactical Accessories. 2013 [retrieved Oct. 3, 2013]. Retrieved from the Internet: <URL: http://www.inteliscopes.com/>.

Nerf NSTRIKE Elite Baattle App Rail Mount. ToysRUs. 2013 [retrieved Oct. 3, 2013]. Retrieved from the Internet: <URL: http://www.toysrus.com/buy/outdoor-play/toy-blasters-foam-play/nerf-nstrike-elite-battle-app-rail-mount-a4472-23058516>.

* cited by examiner

SECURING PLATFORM ACCESSORIES

BRIEF DESCRIPTION OF THE DRAWINGS

FIG. 1 illustrates the securing platform accessory configured for attachment to the firearm via an attached securing platform.

DETAILED DESCRIPTION

The following description and the referenced drawings provide illustrative examples of that which the inventor regards as his inventions. As such, the embodiments discussed herein are merely exemplary in nature and are not intended to limit the scope of the inventor's inventions, or their protection, in any manner. Rather, the description and illustration of these illustrative examples serve to enable a person of ordinary skill in the relevant art to practice the inventions.

The use of "e.g.," "etc," "for instance," "in example," "for example," and "or" and grammatically related terms indicates non-exclusive alternatives without limitation, unless otherwise noted. The use of "including" and grammatically related terms means "including, but not limited to," unless otherwise noted. The use of the articles "a," "an" and "the" are meant to be interpreted as referring to the singular as well as the plural, unless the context clearly dictates otherwise. Thus, for example, reference to "a securing platform" includes two or more such securing platforms, and the like. The use of "optionally," "alternatively," and grammatically related terms means that the subsequently described element, event or circumstance may or may not be present/occur, and that the description includes instances where said element, event or circumstance occurs and instances where it does not. The use of "preferred," "preferably," and grammatically related terms means that a specified element or technique is more acceptable than another, but not that such specified element or technique is a necessity, unless the context clearly dictates otherwise. The use of "exemplary" means "an example of" and is not intended to convey a meaning of an ideal or preferred embodiment. The use of "attached" refers to the fixed, releasable, or integrated association of two or more elements and/or devices. Thus, the term "attached," and grammatically related terms, includes releasably attaching or fixedly attaching two or more elements and/or devices.

Several exemplary securing platform accessories are described herein. The exemplary securing platform accessories can be mounted on an object that has a securing platform.

Figure 1:
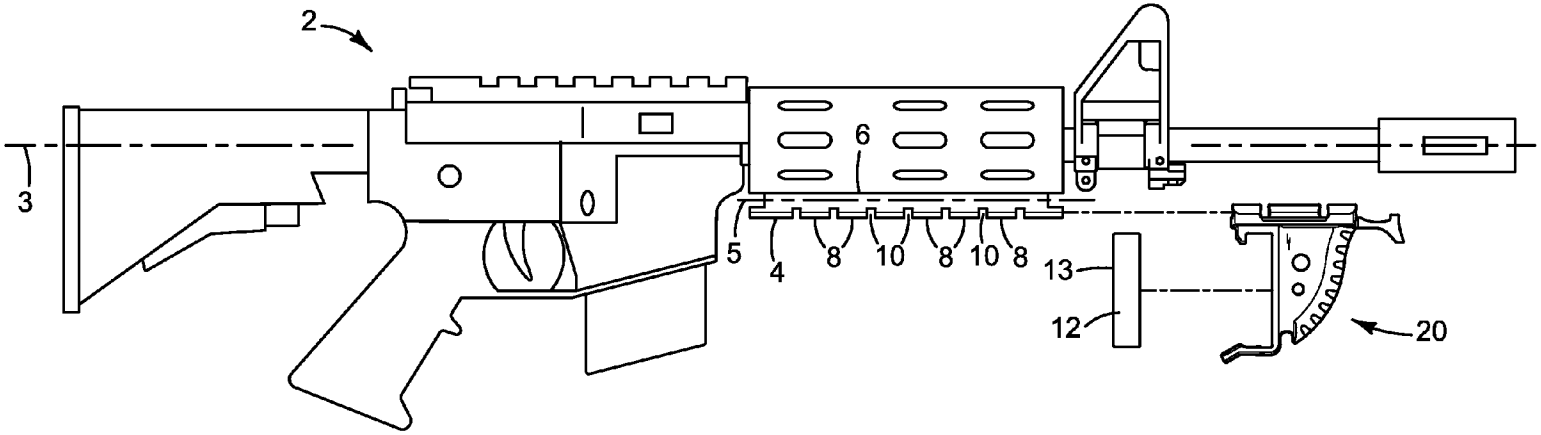
FIG. 1 is an exploded environmental view of a first exemplary securing platform accessory, electronic device, securing platform, and firearm.

A first exemplary securing platform is illustrated in FIGS. 1 through 8. FIGS. 1, 2A, and 2B illustrate a firearm 2 that comprises an attached securing platform 4. FIGS. 2A and 2B illustrate the electronic device 12 and the securing platform accessory 20 attached to the firearm 2 via the securing platform 4. FIGS. 3 through 8 illustrate the securing platform accessory 20 free of the securing platform 4 and the firearm 2. In the embodiment illustrated in these Figures, the electronic device 12 comprises a surface 13 (e.g., screen) and is releasably attached to the securing platform accessory 20. Examples of electronic devices include, but are not limited to, cell phones, smart phones, and handheld computers.

The firearm 2 comprises a lengthwise axis 3 and a base 6 which supports the securing platform 4. The firearm 2 is illustrated as having a base 6 for supporting the securing platform 4, on the underside of the forearm portion of the firearm. While this location is illustrated in FIGS. 1 through 8, it is not intended to be a limitation as to where an exemplary securing platform accessory could be attached—the base for supporting the securing platform could be located elsewhere on the firearm, including but not limited to other surfaces of the forearm, various surfaces of a quad rail, on the stock, and on the flat top portion.

The securing platform 4 is attached to the base 6 and extends from the base 6 away from the lengthwise axis 3 of the firearm 2. The securing platform 4 has a lengthwise axis 5 and is configured to releasably attach a wide variety of articles, such as devices, components, accessories, such as securing platform accessory 20, and the like to the firearm 2.

Figure 2A:
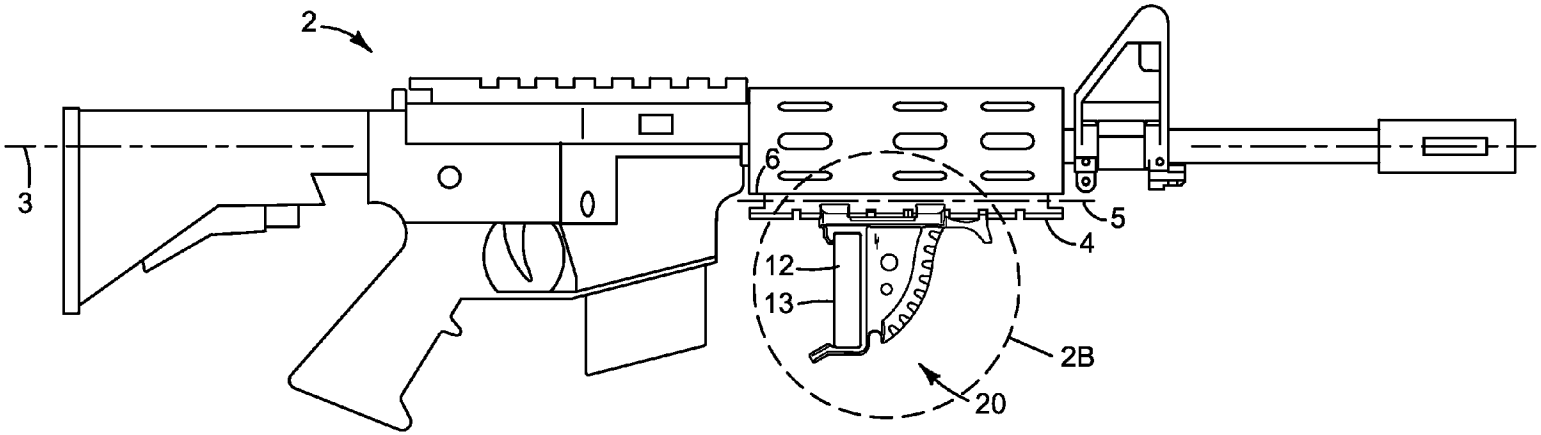
FIG. 2A is an assembled environmental view of the securing platform accessory, electronic device, securing platform, and firearm of FIG. 1.
Figure 2B:
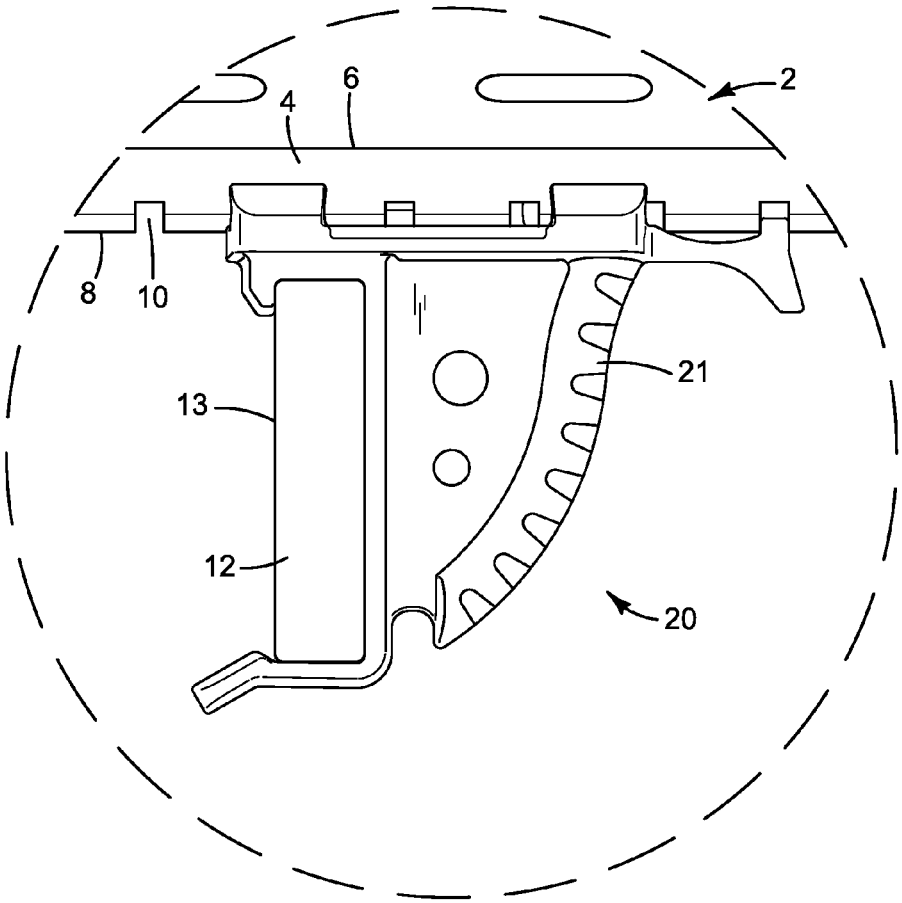
FIG. 2B is an enlarged view of the portion labeled as "2B" in FIG. 2A.
Figures 3, 4, 5, 6, 7:
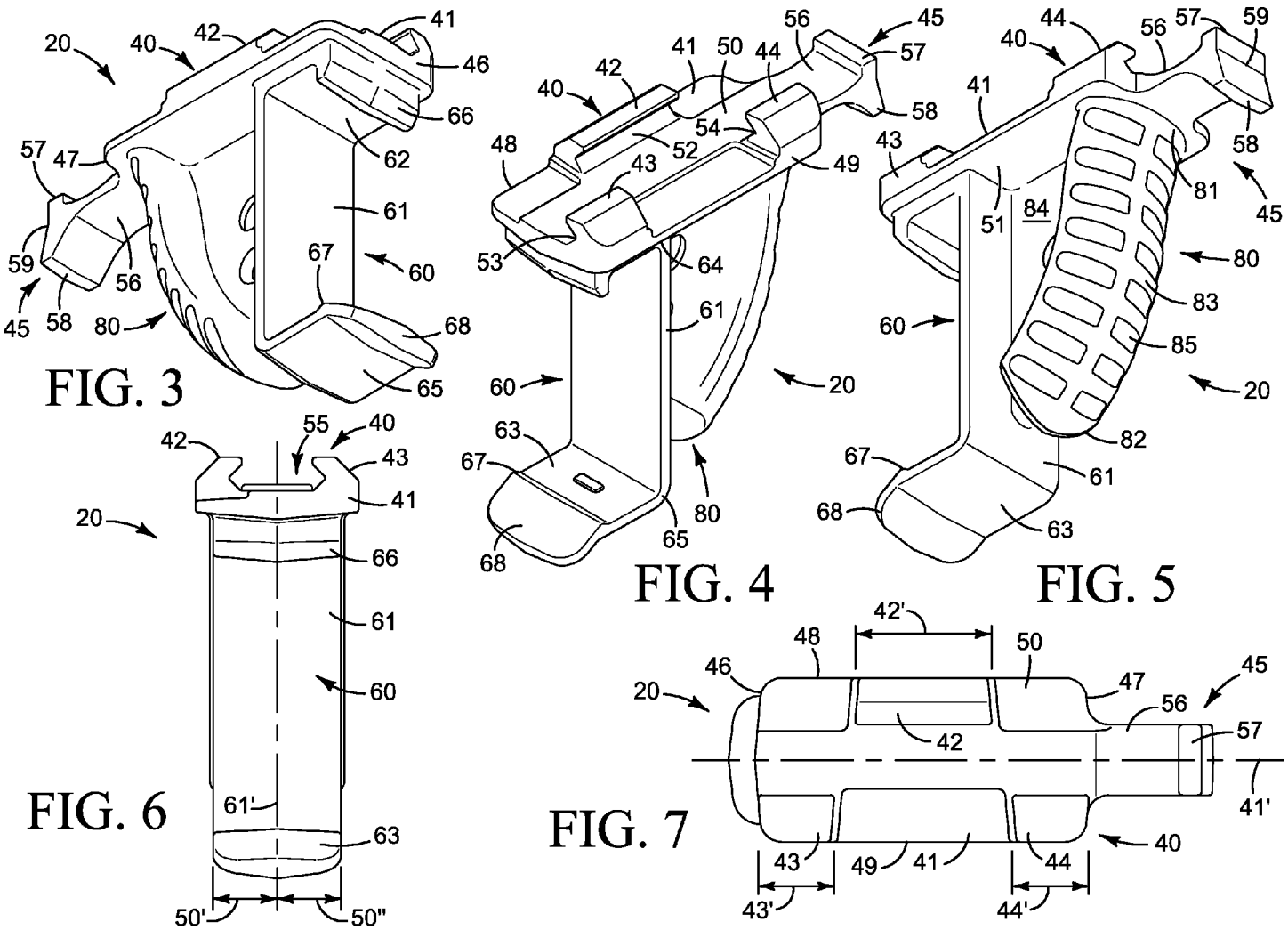
FIG. 3 is a lower, rear, left side perspective view of the securing platform accessory of FIG. 1 free of the firearm.
FIG. 4 is an upper, rear, right side perspective view of the securing platform accessory of FIG. 1 free of the firearm.
FIG. 5 is a lower, front, right side perspective view of the securing platform accessory of FIG. 1 free of the firearm.
FIG. 6 is a rear elevation view of the securing platform accessory of FIG. 1 free of the firearm.
FIG. 7 is top plan view of the securing platform accessory of FIG. 1 free of the firearm.

The securing platform 4 illustrated in FIGS. 1, 2A, and 2B includes a plurality of ridges 8 separated by channels 10, thereby forming a series of peaks and valleys on the securing platform 4. The ridges 8 and channels 10 are configured to interface with reciprocal channels and ridges formed on securing bases of articles, such as devices, components, accessories, and the like, in order to retain the articles thereto.

Any suitable securing platform 4 can be included on a firearm, and skilled artisans will be able to select a suitable securing platform to include on a firearm according to a particular embodiment based on various considerations, such as the devices, components, and/or accessories desired to be releasably attached to the firearm. An example of a securing platform that is considered suitable to include on a firearm is a tactical rail, such a Picatinny rail. A tactical rail includes a bracket used on some firearms in order to provide a standardized mounting platform, which may be used to mount devices, components, accessories, such as exemplary securing platform accessory 20, scopes, flashlights, and the like to the firearm 2. A typical tactical rail includes a series of ridges having a T-shaped cross-section separated by flat spacing slots, or channels. One type of tactical rail, the Picatinny rail, typically has standardized dimensions, such as a slot width of 0.206" (5.23 mm), spacing between slot centers of 0.394" (10.01 mm) and slot depth of 0.118" (3.00 mm).

In the embodiment illustrated in FIGS. 1 through 8, the securing platform accessory 20 comprises a body 21 that defines a rail mount 40, an electronic device holder 60, and a handle 80. The rail mount 40 has a base 41, a first guide 42 on a first side 48 of the rail mount 40, a second guide 43 on a second side 49 of the rail mount 40, a third guide 44 on the first side 48 of the rail mount 40, and a locking mechanism 45. The base 41 has a lengthwise axis 41', a first end 46, a second end 47, a first side 48, a second side 49, a top surface 50, and a bottom surface 51. The top surface 50 is opposably facing the bottom surface 51 and has a first side 50' and a second side 50". The first side 50' of the top surface is opposably positioned from the second side 50" of the top surface relative to a plane that contains the lengthwise axis 41' of the base 41.

While the base 41 has been illustrated as having a generally rectangular configuration, the base of a rail mount can have any structural configuration, and skilled artisans will be able to select a suitable structural configuration for the base of a rail mount according to a particular embodiment based on various considerations, including the structural arrangement of a securing platform. Example structural configurations considered suitable include square, oval, and any other structural configuration considered suitable for a particular embodiment.

Each of the first guide 42, second guide 43, and third guide 44 extends from the top surface 50 of the base 41 and away from the bottom surface 51 of the base 41. The first guide 42, second guide 43, and third guide 44 are sized and configured to slidably receive a portion of the securing platform 4, as shown in FIGS. 1, 2A, and 2B, and as described in more detail below. In the embodiment illustrated in FIGS. 1 through 8, the first guide 42 is disposed on the first side 48' of the top surface 50 and each of the second guide 43 and third guide 44 is disposed on the second side 49" of the top surface 50.

The first guide 42 has a length 42' and defines a notch 52 that is directed toward the plane that contains the lengthwise axis 41' of the base 41. The second guide 43 has a length 43' and defines a notch 53 that is directed toward the plane that contains the lengthwise axis 41' of the base 41. The third guide 44 has a length 44' and defines a notch 54 that is directed toward the plane that contains the lengthwise axis 41' of the base 41. Each of the notches 52, 53, and 54 has a tapered configuration. In this exemplary securing platform accessory, the length 42' of the first guide 42 is greater than the length 43' of the second guide 43 and the length 44' of the third guide 44. The top surface 50 of the base 41, the notch 52 defined by the first guide 42, the notch 53 defined by the second guide 43, and the notch 54 defined by the third guide 44 cooperatively define a channel 55 that is sized and configured to receive a portion of a securing platform (e.g., one or more ridges 8), such as securing platform 4.

The first guide 42 is disposed between the first end 46 and the second end 47 of the base 41. The second guide 43 extends from the first end 46 of the base 41 and toward the second end 47 of the base 41. The third guide 44 extends from the second end 47 of the base 41 and toward the first end 46 of the base 41. In the embodiment illustrated, the first guide 42 is disposed between the second guide 43 and the third guide 44 along the lengthwise axis 41' of base 41.

The locking mechanism 45 is configured for retaining the securing platform accessory 20 on the securing platform 4. The locking mechanism 45 illustrated in FIGS. 1 through 8 has a flexible shaft 56, a first ridge 57, and a second ridge 58. The shaft 56 extends from the second end 47 of the base 41 and away from the first end 45 of the base 41 to a shaft end 59. The first ridge 57 extends from the shaft 56 and away from the bottom surface 51 of the base 41. The first ridge 57 is sized and configured to be received by a channel of a securing platform, such as a channel 10 of securing platform 4. The second ridge 58 extends from the shaft 56 and away from the top surface 50 of the base 41. The second ridge 58 is sized and configured to provide a surface for a user to apply a force to the locking mechanism 45 to release the first ridge 57 from the channel 10 of a securing platform 4, as described in more detail herein. When a force is applied to the second ridge 58 the shaft 56 of the locking mechanism 45 the shaft 55 moves relative to the lengthwise axis 41' of the base 41 such that the first ridge 57 can be released from within a channel 10 of the securing platform 4.

While the rail mount 40 has been illustrated as including a first guide 42, a second guide 43, and a third guide 44, the rail mount of a securing platform accessory can include any suitable number guides. For instance, the first guide and the third guide could be joined together to form a first side guide, and the second guide could be lengthened to form a second side guide. Skilled artisans will be able to select a suitable number and configuration of guides to include on a rail mount of a securing platform accessory according to a particular embodiment based on various considerations, including the structural arrangement of a securing platform to which the securing platform accessory will be attached. Example number of guides considered suitable to include on a securing platform accessory include one, at least one, two, a plurality, three, four, five, six, and any other number considered suitable for a particular embodiment.

While each of the first guide 42, second guide 43, and third guide 44 has been illustrated as defining a notch that has a tapered configuration, a guide can define a notch having any suitable structural configuration. Skilled artisans will be able to select a suitable structural configuration for a notch included on a guide according to a particular embodiment based on various considerations, including the structural configuration of a securing platform. Example structural configurations considered suitable for a notch defined on a guide include notches that are curved, rectangular, square, and any other structural configuration considered suitable for a particular embodiment.

While each of the first guide 42, second guide 43, and the third guide 44 has been illustrated as extending from a particular side of the top surface of the base 41, a guide can extend from any suitable portion of the base of a securable platform accessory. Skilled artisans will be able to select a suitable position to locate a guide on a base of a securing platform accessory according to a particular embodiment based on various considerations, including the structural configuration of a securing platform to which the securing platform accessory is to be attached. Example positions considered suitable to locate a guide on a base include on the first end of a base, on the second end of a base, on a first side of the base, on a second side of the base, between the first end and second end of the base, and any other position considered suitable for a particular embodiment.

While the locking mechanism 45 has been illustrated as having a particular structural arrangement, the locking mechanism of a securing platform accessory can have any suitable structural arrangement capable of releasably attaching the securing platform accessory to another component (e.g., securing platform 4). The locking mechanisms of other exemplary securing platform accessories may take a different configuration, including but not limited using mechanical devices for fixing the securing platform accessory in place, and holding the securing platform accessory in place using friction and/or a compression fit. Skilled artisans will be able to select a suitable structural arrangement for a locking mechanism according to a particular embodiment based on various considerations, such as the structural arrangement of a securing platform to which the securing platform accessory is to be attached. For example, the locking mechanism of a securing platform accessory can have a varying profile and/or be contoured differently than that illustrated in FIGS. 1 through 8, and/or it can include one or more ridges that extend from the shaft and away from the bottom surface of a base such that each ridge is sized and configured to be received by a channel defined by a securing platform.

The electronic device holder 60 is attached to the rail mount 40 (e.g., the bottom surface 51 of the base 41) and has a back support member 61, top support member 62, and a bottom support member 63. In combination, the back support member 61, top support member 62, and bottom support member 63 form a "C" shaped receiver for an electronic device, such as electronic device 12 illustrated in FIGS. 1, 2A, and 2B. The back support member 61 has a lengthwise axis 61', a first end 64, and a second end 65. The first end 64 of the back support member 61 is attached to the bottom surface 51 of the base 41 between the first end 46 and the second end 47 of the base 41. The back support member 61 extends from the bottom surface 51 of the base 41 and away from the top surface 50 of the base 41 to the second end 65. The lengthwise axis 61' of the back support member 61 passes through, and is perpendicular to, the lengthwise axis 41' of the base 41.

While the lengthwise axis 61' of the back support member 61 has been described as disposed perpendicular to the lengthwise axis 41' of the base 41, a back support member can be disposed at any suitable angle to the base of a securing platform accessory. Skilled artisans will be able to select a suitable angle to position the back support member of an electronic device holder relative to the base of a rail mount according to a particular embodiment based on various considerations, including the angle at which it is desired to position an electronic device relative to the base during use. Example angles considered suitable to position a back support member relative to a base include obtuse angles, acute angles, angles that position the back support member perpendicular to, or substantially perpendicular to, the base, and any other angle considered suitable for a particular embodiment.

The top support member 62 extends from the back support member 61 and toward the first end 46 of the base 41 and is attached to the bottom surface 51 of the base 41. Alternatively, a top support member can be free of attachment to the bottom surface 51 of the base 41. The top support member 62 defines a protuberance 66 that extends from the top support member 62 and toward the bottom support member 63 of the electronic device holder 60. The protuberance 66 is disposed a distance 66' from the back support member 61 that is configured to receive the thickness of an electronic device, such as electronic device 12 illustrated in FIGS. 1, 2A, and 2B. The distance 66' is measured on a plane that contains the lengthwise axis 41' of base 41 and the axis 61' of the back support member 61. Optionally a top support member can be omitted from a securing platform accessory, such that a portion of the bottom surface of the base, the back support member, and the bottom support member form a "C" shaped receiver for an electronic device, such as electronic device 12. In this optional embodiment, the bottom surface of the base can define a protuberance (e.g., protuberance 66) that is disposed a distance from the back support member (e.g., distance 66').

The distance 66' between the back support member 61 and the protuberance 66 can be any suitable distance, and skilled artisans will be able to select a suitable distance between the back support member and the protuberance of an electronic device holder according to a particular embodiment based on various considerations, including the structural configuration of an electronic device. For example, the distance between the back support member and the protuberance of an electronic device holder can be equal, or substantially equal to, the thickness of an electronic device, the thickness of an electronic device with a protective case, or any other distance considered suitable for a particular embodiment.

The bottom support member 63 extends from the back support member 61 and is positioned opposite the top support member 62. Thus, the top support member 62 has a lengthwise axis that is parallel to the lengthwise axis of the bottom support member 63 and the lengthwise axis 41' of the base 41. The bottom support member 63 is disposed a distance 63' from the top support member 62 that is configured to receive the length of an electronic device, such as electronic device 12 illustrated in FIGS. 1, 2A, 2B. In this exemplary securing platform accessory, the distance 63' is greater than the distance 66' between the back support member 61 and protuberance 66 and is measured on a plane that contains the lengthwise axis 41' of base 41 and the axis 61' of the back support member 61.

The bottom support member 63 defines a protuberance 67 and an angled end portion 68. The protuberance 67 extends from the bottom support member 63 and toward the bottom surface 51 of the base 41. The protuberance 67 is sized and configured to releasably attach an electronic device, such as electronic device 12, to the electronic device holder 60. The angled end portion 68 extends from the protuberance 67 and away from the back support member 61 and the bottom surface 51 of the base 41. The angled end portion 68 provides a mechanism for manipulating the position of the bottom support member 63 such that an electronic device, such as electronic device 12, can be positioned within and removed from within electronic device holder 60.

The distance 63' between the top support member 62 and the bottom support member 63 can be any suitable distance, and skilled artisans will be able to select a suitable distance between the top support member and the bottom support member of an electronic device holder according to a particular embodiment based on various considerations, including the structural configuration of an electronic device. For example, the distance between the top support member and the bottom support member of an electronic device holder can be equal, or substantially equal to, the width or length of an electronic device, the width or length of an electronic device with a protective case, or any other distance considered suitable for a particular embodiment. Alternatively, in embodiments in which the top support member has been omitted, the distance 63' can be measured from the bottom surface 51 of the base 41 to the bottom support member 63.

In the embodiment illustrated, the back support member 61 and/or the top support member 62 are/is formed of a first material and the bottom support member 63 is formed of a second material. It is preferred that the back support member 61 and/or the top support member 62 be configured to be more flexible than that bottom support member 63. The first material can be the same as, or different than, the second material. In one exemplary embodiment, the second material can be itself relatively more flexible than the first material. This configuration provides a mechanism for releasably attaching an electronic device within the electronic device holder 60, as described in more detail herein.

The electronic device holder 60 is sized and configured to releasably house an electronic device 12, as shown in FIGS. 1, 2A, and 2B. The electronic device holder 60 can be sized and configured to receive any suitable electronic device, and skilled artisans will be able to select a suitable electronic device according to a particular embodiment based on various considerations, including the structural arrangement of the electronic device. Example electronic devices considered suitable to house in an electronic device holder include cellular phones, hand-held devices, digital media devices, smart phones, personal digital assistants (PDAs), hand-held computers, global positioning system (GPS) devices, and any other device considered suitable for a particular embodiment.

The handle 80 is attached to the bottom surface 51 of the base 41 and extends away from the top surface 50 of the base 41. The handle 80 has a first end 81, second end 82, a grip 83, and a support member 84. The first end 81 of the handle 80 is attached to the bottom surface 51 of the base 41 between the first end 46 and the second end 47 of the base 41. The handle 80 extends from the bottom surface 51 of the base 41 and away from the top surface 50 of the base 41 to the second end 82. The grip 83 extends from the first end 81 of the handle 80 to the second end 82 of the handle 80 and has an ergonomically sinusoidal structural arrangement. In the embodiment illustrated, the grip 83 is spaced from the electronic device holder 60 along the lengthwise axis 41' of the base 41. The grip 83 defines a plurality of recesses 85 that provide increased gripping capabilities during use.

The support member 84 is disposed between the electronic device holder 60 and the grip 83. The support member 84 is attached to the back support member 61 of the electronic device holder 60, the bottom surface 51 of the base 41, and the grip 83. The support member 84 defines a plurality of passageways 86. Each passageway of the plurality of passageways 86 extends through the thickness of the support member 84 and is sized and configured to receive another component, such as a stylus of an electronic device. For example, each passageway of the plurality of passageways can serve as a housing for a stylus device on the securing platform accessory 20 when the firearm 2 is in use. Optionally, the support member can be omitted from a handle.

While the support member 84 of the handle 80 has been illustrated as including a plurality of passageways 86, the support member of a handle can include any suitable number of passageways. Skilled artisans will be able to select a suitable number of passageways to include on the support member of a handle according to a particular embodiment based on various considerations, including the device intended to be housing within each passageway. Example number of passageways considered suitable to include on the support member of a handle include zero, one, at least one, two, a plurality, three, four, and any other number considered suitable for a particular embodiment.

While the grip 83 has been illustrated as having an ergonomically sinusoidal structural arrangement, the grip of a handle can have any suitable structural arrangement and skilled artisans will be able to select a suitable structural arrangement for a grip according to a particular embodiment based on various considerations, including the structural arrangement of the rail mount of a securing platform accessory. Example structural arrangements considered suitable for a grip include curved, linear, and any other structural arrangement considered suitable for a particular embodiment.

The securing platform accessory 20 can be formed of any suitable material and can be manufactured using any suitable technique. Skilled artisans will be able to select a suitable material and method of manufacture for a securing platform accessory according to a particular embodiment based on various considerations, including the desired structural configuration of the securing platform accessory and/or the materials that form a rail mount to which the securing platform accessory is desired to be attached. Example materials considered suitable include metals, plastics, and combinations thereof.

An example method of manufacture considered suitable for a securing platform accessory includes injection molding. For example, a securing platform accessory can be manufactured as a single pull injection molded part. A single pull part, in terms of injection molding, is a part that requires two mold cavities; a top and a bottom. During the injection molding process, after the plastic material has been injected and cools, the top mold is raised and then ejection pins from the bottom mold push the finished part out. This is accomplished by pulling one half of the mold.

While the securing platform accessory 20, has been illustrated as having a particular structural arrangement, a securing platform accessory can have any suitable structural arrangement. Skilled artisans will be able to select a suitable structural arrangement for a securing platform accessory according to a particular embodiment based on various considerations, including the materials that form the securing platform accessory.

In the embodiment illustrated in FIGS. 1 through 8, the securing platform accessory 20 (e.g., rail mount 40, electronic device holder 60, handle 80) is formed of a single contiguous piece of material. However, alternative embodiments include a securing platform accessory that is formed of multiple pieces attached to each other using any suitable technique, such as using adhesive, mechanical fasteners, or any other technique considered suitable for a particular embodiment. For example, each of the rail mount, electronic device holder, and handle can comprise separate components attached to one another using any suitable method of attachment.

While the securing platform accessory 20 has been illustrated as including a rail mount 40, electronic device holder 60, and a handle 80, a securing platform accessory can omit any of these elements. Skilled artisans will be able to select a suitable number of elements to include on a securing platform accessory according to a particular embodiment based on various considerations, such as the structural configuration of a rail mount to which the securing platform accessory will be attached. For example, alternative to including a rail mount, electronic device holder, and a handle, a securing platform accessory can include a rail mount and an electronic device holder, or a rail mount and a handle.

To install the securing platform accessory 20, one or more ridges 8 of the securing platform 4 are positioned within the channel 55 defined by the rail mount 40 (e.g., between the top surface 50 of the base 41 and the first guide 42, second guide 43, and third guide 44) at the first end 46 of the base 41. Subsequently, a force can be applied on the securing platform accessory 20 (e.g., grip 83) along the lengthwise axis 41' of the base 41 until the securing platform accessory 20 is positioned on the securing platform 4 at a desired location. During placement of the securing platform accessory 20 on the securing platform 4, the locking mechanism 45 has a first configuration and a second configuration. In the first configuration, a force is applied on the locking mechanism 45 (e.g., second ridge 58) in a direction away from the securing platform 4 and toward the grip 83 of the handle 80. In the first configuration, the securing platform accessory 20 is slidable along the securing platform 4. In the second configuration, no force is applied to the locking mechanism 45 (e.g., second ridge 58), or if a force has been applied to the locking mechanism (e.g., second ridge 58) the force is removed, such that the first ridge 56 of the locking mechanism 45 is disposed within a channel 10 defined by the securing platform 4. In the second configuration, the securing platform accessory 20 is releasably attached to the securing platform 4.

To remove the securing platform accessory 20, the locking mechanism 45 is moved from the second configuration to the first configuration, as described above, and a force is applied on the securing platform accessory 20 (e.g., grip 83) along the lengthwise axis 41' of the base 41 until the securing platform accessory 20 is free of the securing platform 4. The structural configuration of the securing platform accessory 20 provides for one-handed installation and removal of the securing platform accessory 20 on a securing platform.

An electronic device, such as electronic device 12, can be positioned within the electronic device holder 60 prior to, during, or subsequent to, the securing platform accessory 20 being releasably attached to the securing platform 4. The electronic device 12 can be positioned within, and removed from, the electronic device holder 60 by moving the bottom support member 63 between a first position and a second position. In the first position, as illustrated in FIGS. 1 through 8, the bottom support member 63 is disposed a first distance from the bottom surface 51 of the base 41 and no force is applied to the bottom support member 63 (e.g., angled end portion 68). In the second position, the bottom support member 63 is disposed a second distance from the bottom surface 51 of the base 41 and a force is applied to the bottom support member 63 (e.g., angled end portion 68). The second distance is greater than the first distance. Thus, movement of the bottom support member 63 from the first position to the second position moves the bottom support member 63 away from the bottom surface 51 of the base 41.

After the electronic device 12 is positioned within the electronic device holder 60 (e.g., the electronic device 12 contacts the back support member 61), the force being applied to the bottom support member 63 can be removed such that the bottom support member 63 returns to its first position. This action releasably attaches the electronic device 12 to the securing platform accessory 20 by compressing it between the top support member 62 and the bottom support member 63. FIGS. 2A and 2B illustrate the electronic device 12 releasably attached to the securing platform accessory 20. When disposed within the electronic device holder 60, the surface 13 of the electronic device 12 is disposed on a plane that is perpendicular to the lengthwise axis 5 of the securing platform 4 and the lengthwise axis 41' of the base 41.

With an electronic device 12 attached to the firearm 2 via a securing platform accessory 20, a user can accomplish any suitable task. For example, a user can obtain images of an event, can obtain and/or record video of an event (e.g., high definition video of sport shooting, hunting, and/or tactical shooting drills). Alternatively, the electronic device 12 attached to the firearm 2 via a securing platform accessory 20 can utilize ballistic calculator applications.

Figure 9:
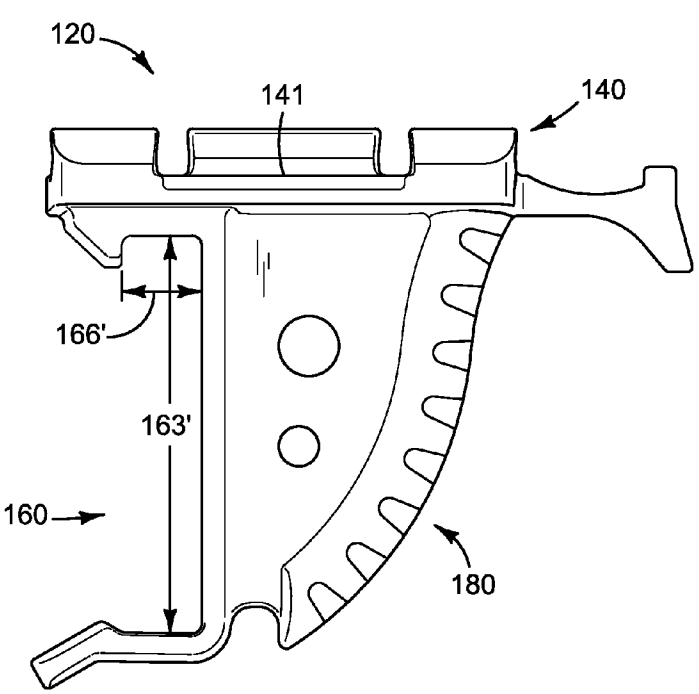
FIG. 9 is a right side elevation view of a second exemplary securing platform accessory.
Figure 8:
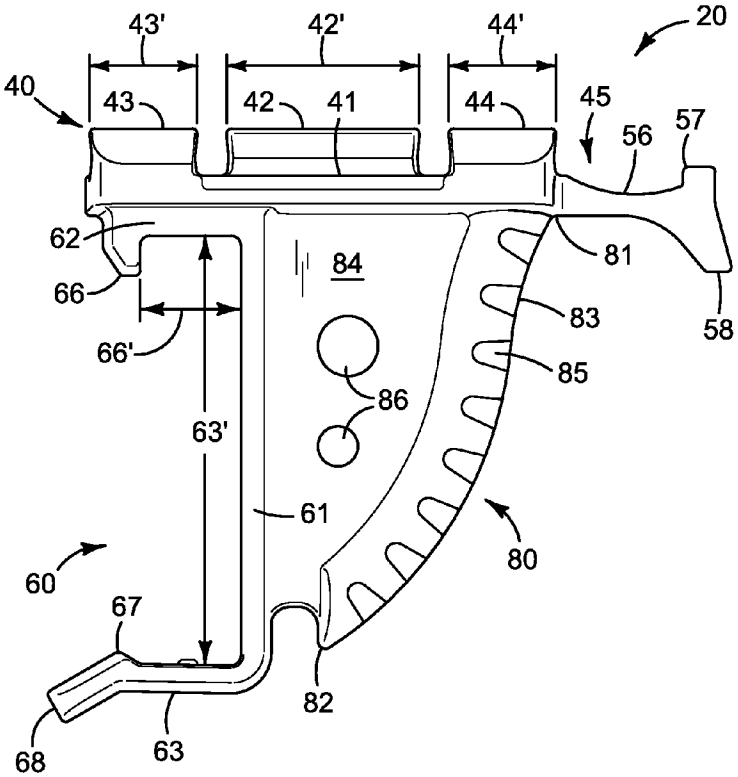
FIG. 8 is a right side elevation view of the securing platform accessory of FIG. 1 free of the firearm.

Referring now to FIG. 9, the second exemplary securing platform accessory 120 is shown. The second exemplary securing platform accessory 120 is similar to the first exemplary securing platform accessory 20 illustrated in FIGS. 1 through 8, and described above, except as detailed below. Reference numbers in FIG. 9 refer to the same structural element or feature referenced by the same number in FIGS. 1 through 8, offset by 100. Thus, the second exemplary securing platform accessory 120 comprises a rail mount 140, electronic device holder 160, and a handle 180.

In the embodiment illustrated in FIG. 9, the distance 166' between the back support member 161 and the protuberance 166 defined on the top support member 162 is less than the distance 66' illustrated in FIGS. 1 through 8. In addition, the distance 163' between the top support member 162 and the bottom support member 163 is less than the distance 63' illustrated in FIGS. 1 through 8. The differences in the distances enabling the electronic device holder 160 to receive a differently shaped electronic device than the electronic device holder 60 of FIGS. 1 through 8.

Figure 10:
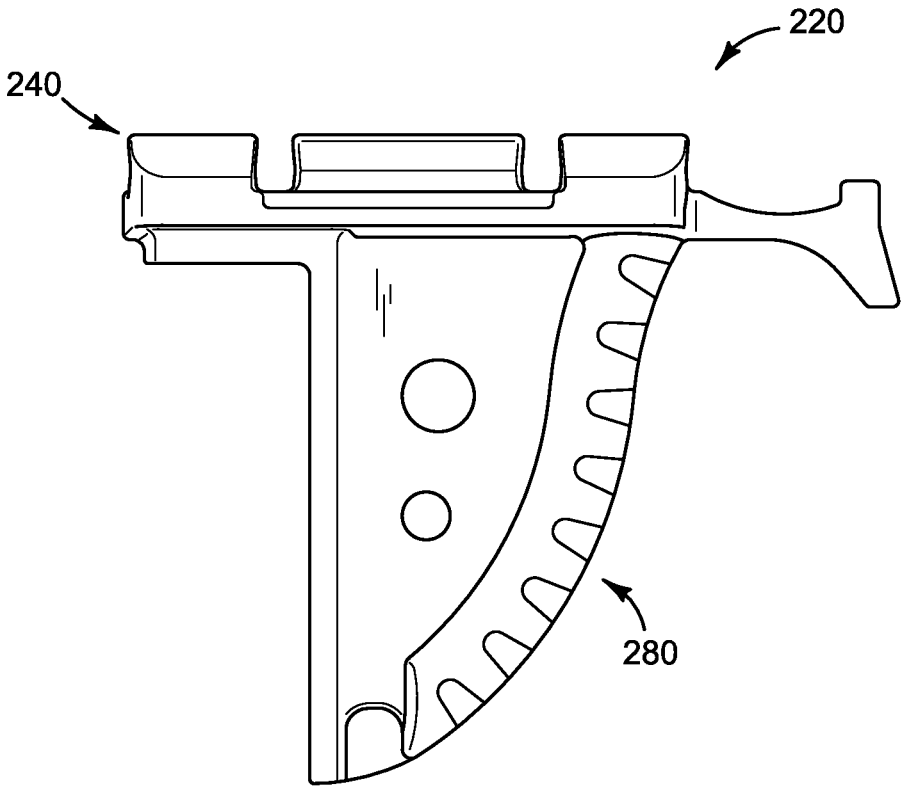
FIG. 10 is a right side elevation view of a third exemplary securing platform accessory.

Referring now to FIG. 10, the third exemplary securing platform accessory 220 is shown. The third exemplary securing platform accessory 220 is similar to the first exemplary securing platform accessory 20 illustrated in FIGS. 1 through 8, and described above, except as detailed below. Reference numbers in FIG. 10 refer to the same structural element or feature referenced by the same number in FIGS. 1 through 8, offset by 200. Thus, the third exemplary securing platform accessory 220 comprises a rail mount 240 and a handle 280.

In the embodiment illustrated in FIG. 10, the securing platform accessory 220 omits the inclusion of an electronic device holder (e.g., electronic device holder 60 illustrated in FIGS. 1 through 8). This embodiment provides a handle 280 that is releasably attachable to a securing platform (e.g., securing platform 4 illustrated in FIGS. 1, 2A, and 2B).

The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed is:

1. A securing platform accessory comprising:

a rail mount having a base, a first guide, and a second guide, the base having a lengthwise axis, a top surface, and a bottom surface, the top surface having a first side and a second side, the first side of the top surface opposably positioned from the second side of the top surface relative to a plane that contains the lengthwise axis of the base, the first guide extending from the first side of the top surface and away from the bottom surface of the base, the second guide extending from the second side of the top surface and away from the bottom surface of the base, wherein the base has a first end and a second end, wherein the rail mount further comprises a locking mechanism having a shaft and a ridge, the shaft extending from the second end of the base and away from the first end of the base, the ridge disposed on the shaft and extending away from the bottom surface of the base;

an electronic device holder attached to the rail mount, the electronic device holder having a back support member and a bottom support member, the back support member extending from the bottom surface of the base and away from the top surface of the base, the bottom support member extending from the back support member; and a handle attached to the bottom surface of the base and extending away from the top surface of the base, the handle having a grip spaced from the electronic device holder along the lengthwise axis of the base.

2. The securing platform accessory of claim 1, wherein the rail mount comprises a third guide, the third guide extending from the second side of the top surface and away from the bottom surface of the base.

3. The securing platform accessory of claim 2, wherein the first guide is disposed between the second guide and the third guide along the lengthwise axis of the base.

4. The securing platform accessory of claim 1, wherein the back support member of the electronic device holder has a lengthwise axis; and wherein the lengthwise axis of the back support member is disposed perpendicular to the lengthwise axis of the base.

5. The securing platform accessory of claim 4, wherein the bottom support member has a lengthwise axis; and wherein the lengthwise axis of the bottom support member is disposed perpendicular to the lengthwise axis of the back support member; and wherein the lengthwise axis of the bottom support member is parallel to the lengthwise axis of the base.

6. The securing platform accessory of claim 1, wherein the handle further comprises a support member, the support member attached to the bottom surface of the base, the support member disposed between the back support member of the electronic device holder and the grip of the handle.

7. The securing platform accessory of claim 6, wherein the support member of the handle has a thickness; and wherein the support member of the handle defines a passageway that extends through the thickness of the support member of the handle.

8. The securing platform accessory of claim 1, wherein the rail mount, electronic device holder, and the handle comprise a contiguous piece of material.

9. The securing platform accessory of claim 1, wherein the back support member of the electronic device holder is formed of a first material; wherein the bottom support member of the electronic device holder is formed of a second material; and wherein the second material is relatively more flexible than the first material.

10. A securing platform accessory comprising:

a rail mount having a base, a first guide, a second guide, and a locking mechanism, the base having a lengthwise axis, a top surface, a bottom surface, a first end, and a second end, the top surface having a first side and a second side, the first side of the top surface opposably positioned from the second side of the top surface relative to a plane that contains the lengthwise axis of the base, the first guide extending from the first side of the top surface and away from the bottom surface of the base, the second guide extending from the second side of the top surface and away from the bottom surface of the base, the locking mechanism having a shaft and a ridge, the shaft extending from the second end of the base and away from the first end of the base, the ridge disposed on the shaft and extending away from the bottom surface of the base;

an electronic device holder attached to the rail mount, the electronic device holder having a back support member and a bottom support member, the back support member extending from the bottom surface of the base and away from the top surface of the base, the bottom support member extending from the back support member; and a handle attached to the bottom surface of the base and extending away from the top surface of the base, the handle having a grip spaced from the electronic device holder along the lengthwise axis of the base.

11. The securing platform accessory of claim 10, wherein the rail mount comprises a third guide, the third guide extending from the second side of the top surface and away from the bottom surface of the base.

12. The securing platform accessory of claim 11, wherein the first guide is disposed between the second guide and the third guide along the lengthwise axis of the base.

13. The securing platform accessory of claim 10, wherein the back support member of the electronic device holder has a lengthwise axis; and wherein the lengthwise axis of the back support member is disposed perpendicular to the lengthwise axis of the base.

14. The securing platform accessory of claim 13, wherein the bottom support member has a lengthwise axis; and wherein the lengthwise axis of the bottom support member is disposed perpendicular to the lengthwise axis of the back support member; and wherein the lengthwise axis of the bottom support member is parallel to the lengthwise axis of the base.

15. The securing platform accessory of claim 10, wherein the handle further comprises a support member, the support member attached to the bottom surface of the base, the support member disposed between the back support member of the electronic device holder and the grip of the handle.

16. The securing platform accessory of claim 15, wherein the support member of the handle has a thickness; and wherein the support member of the handle defines a passageway that extends through the thickness of the support member of the handle.

17. The securing platform accessory of claim 10, wherein the rail mount, electronic device holder, and the handle comprise a contiguous piece of material.

18. The securing platform accessory of claim 10, wherein the back support member of the electronic device holder is formed of a first material; wherein the bottom support member of the electronic device holder is formed of a second material; and wherein the second material is relatively more flexible than the first material.

19. A securing platform accessory comprising:

a rail mount having a base, a first guide, a second guide, a third guide, and a locking mechanism, the base having a lengthwise axis, a top surface, a bottom surface, a first end, and a second end, the top surface having a first side and a second side, the first side of the top surface opposably positioned from the second side of the top surface relative to a plane that contains the lengthwise axis of the base, the first guide extending from the first side of the top surface and away from the bottom surface of the base, the second guide extending from the second side of the top surface and away from the bottom surface of the base, the third guide extending from the second side of the top surface and away from the bottom surface of the base, the locking mechanism having a shaft and a ridge, the shaft extending from the second end of the base and away from the first end of the base, the ridge disposed on the shaft and extending away from the bottom surface of the base;

an electronic device holder attached to the rail mount, the electronic device holder having a back support member and a bottom support member, the back support member extending from the bottom surface of the base and away from the top surface of the base, the bottom support member extending from the back support member; and a handle attached to the bottom surface of the base and extending away from the top surface of the base, the handle having a grip spaced from the electronic device holder along the lengthwise axis of the base.

20. A securing platform accessory comprising:

a rail mount having a base, a first guide, a second guide, and a third guide, the base having a lengthwise axis, a top surface, and a bottom surface, the top surface having a first side and a second side, the first side of the top surface opposably positioned from the second side of the top surface relative to a plane that contains the lengthwise axis of the base, the first guide extending from the first side of the top surface and away from the bottom surface of the base, the second guide extending from the second side of the top surface and away from the bottom surface of the base, the third guide extending from the second side of the top surface and away from the bottom surface of the base, wherein the first guide is disposed between the second guide and the third guide along the lengthwise axis of the base;

an electronic device holder attached to the rail mount, the electronic device holder having a back support member and a bottom support member, the back support member extending from the bottom surface of the base and away from the top surface of the base, the bottom support member extending from the back support member; and a handle attached to the bottom surface of the base and extending away from the top surface of the base, the handle having a grip spaced from the electronic device holder along the lengthwise axis of the base.

21. A securing platform accessory comprising:

a rail mount having a base, a first guide, and a second guide, the base having a lengthwise axis, a top surface, and a bottom surface, the top surface having a first side and a second side, the first side of the top surface opposably positioned from the second side of the top surface relative to a plane that contains the lengthwise axis of the base, the first guide extending from the first side of the top surface and away from the bottom surface of the base, the second guide extending from the second side of the top surface and away from the bottom surface of the base;

an electronic device holder attached to the rail mount, the electronic device holder having a back support member and a bottom support member, the back support member extending from the bottom surface of the base and away from the top surface of the base, the bottom support member extending from the back support member; and a handle attached to the bottom surface of the base and extending away from the top surface of the base, the handle having a grip spaced from the electronic device holder along the lengthwise axis of the base, wherein the handle further comprises a support member, the support member attached to the bottom surface of the base, the support member disposed between the back support member of the electronic device holder and the grip of the handle, wherein the support member of the handle has a thickness, and wherein the support member of the handle defines a passageway that extends through the thickness of the support member of the handle.

* * * * *